United States Patent [19]

Mühlhausen et al.

[11] Patent Number: 4,947,728

[45] Date of Patent: Aug. 14, 1990

[54] COMBAT VEHICLE, ESPECIALLY ARMORED HOWITZER

[75] Inventors: Peter Mühlhausen, Ahnatal; Ernst Tripp, Vellmar, both of Fed. Rep. of Germany

[73] Assignee: Wegmann & Co. GmbH, Kassel, Fed. Rep. of Germany

[21] Appl. No.: 320,015

[22] Filed: Mar. 7, 1989

[30] Foreign Application Priority Data

Mar. 8, 1988 [DE] Fed. Rep. of Germany ..... 3807424

[51] Int. Cl.[5] ..... F41A 9/11

[52] U.S. Cl. ..... 89/46

[58] Field of Search ..... 89/45, 46, 47, 36.08

[56] References Cited

U.S. PATENT DOCUMENTS

| | | | |
|---|---|---|---|
| 4,318,331 | 3/1982 | Echtler et al. | 89/46 |
| 4,438,677 | 3/1984 | Spotzl et al. | 89/47 |
| 4,448,107 | 5/1984 | Kotai et al. | 89/45 |
| 4,648,305 | 3/1987 | Elspass | 89/36.08 |

FOREIGN PATENT DOCUMENTS

| | | | |
|---|---|---|---|
| 3642920 | 6/1988 | Fed. Rep. of Germany | 89/46 |
| 1523432 | 8/1978 | United Kingdom | 89/46 |

OTHER PUBLICATIONS

K. C. Pan, (Applications to Armament) Army Research, Development and Acquisition Magazine, 10/83, pp. 15–17.

D. H. C. Jenkins, (Ladeautomaten für Panzer), Internationale Wehrrevue, 7/84, pp. 907–910 and 914–918.

*Primary Examiner*—Charles T. Jordan
*Assistant Examiner*—Stephen Johnson
*Attorney, Agent, or Firm*—Sprung Horn Kramer & Woods

[57] ABSTRACT

A mechanism for feeding the shells to a weapon one at a time comprises a conveyor for removing one shell from at least one ammunition magazine comprising a frame, mounted for rotation about an axis perpendicular to a floor for movement from a pick-up position to a transfer position, rails on the frame disposed parallel to the floor, an arm slidably mounted on the rails for movement therealong parallel to the floor, a gripper mounted on the arm for gripping a shell and pivotable from a first position wherein the shell is upright to a second position wherein the shell is aligned with the length of the vehicle. The gripper is operative in the first position to grip a shell when the frame is in the pick-up position and is operative in the second position to release a shell when the frame is in the transfer position. A shell tray is mounted for sliding movement parallel to the floor between a receiving position wherein the tray receives a shell released by the gripper and a holding position. The tray is rotatable about an axis perpendicular to the floor from the holding position to a loading position parallel to a bore of the weapon and is elevatable to align the shell with the bore for sliding movement thereunto.

7 Claims, 13 Drawing Sheets

COMBAT VEHICLE, ESPECIALLY ARMORED HOWITZER

BACKGROUND OF THE INVENTION

The invention concerns a combat vehicle, especially an armored howitzer, with a rotating turret behind its center, with a heavy weapon that can be elevated and lowered mounted on the turret, with at least one ammunition magazine inside and near the center of the vehicle that accommodates ammunition stowed upright while leaving an access space essentially extending along the length of the vehicle, and with an automatic ammunition feed that removes one shell at a time from the ammunition magazine, rotates and aligns it parallel with the length of the vehicle, conveys it to the rear of the weapon, orients it such that it matches the orientation of the weapon in azimuth and elevation at that particular instant, and lifts it into the firing position, whereby the ammunition feed comprises (a) an ammunition conveyor in the vicinity of the ammunition magazine with an arm that has a pivoting grip at the end, (b) an load-ready round tray behind the ammunition conveyor in terms of the length of the vehicle, (c) an ammunition-conveying rail behind the ammunition conveyor that rotates around an axis perpendicular to the floor of the vehicle and concentric with the axis that the turret rotates around, (d) an ammunition-transfer arm that pivots independent of the weapon on the weapon's trunnion within the plane of elevation or in a plane parallel thereto, that can be lowered into the vehicle, and that has a loading tray at the free end and behind the weapon, and (e) drive mechanisms and controls for the ammunition conveyor, the ammunition-conveying rail, and the ammunition-transfer arm.

A combat vehicle of this type is known, from German OS 3 642 920 A1, which was not published prior to the instant application, for example.

In the older combat vehicle, the ammunition is obtained from the ammunition conveyor by means of a ammunition-conveying arm perpendicular to the floor of the vehicle and moving in a plane parallel to the floor. At the other end of the arm is a pivoting grip. The ammunition-conveying arm is suspended from and slides along a rail that extends along the length of the vehicle and is itself suspended from and slides perpendicular to the length of the vehicle along two rails that extend perpendicular to the length of the vehicle.

When ammunition is supplied, a shell is removed by the ammunition-conveying arm, rotated 90°, and oriented parallel with the length of the vehicle. It is finally inserted into a load-ready round tray that is secured to the floor and parallels the length of the vehicle, whence an ejector thrusts it into an ammunition-conveying rail, where advance mechanisms convey it farther forward. The ammunition-conveying rail is oriented parallel with the particular position of the weapon at any moment. The ammunition-transfer arm, which has a pivoting loading tray mounted on it, is then lowered until the tray enters the ammunition-conveying rail and positions itself coaxial with it. The shell can now be thrust into the loading tray and, once the ammunition-transfer arm has been pivoted up into its limiting position, brought to the rear of the weapon.

SUMMARY OF THE INVENTION

The object of the invention is to improve a combat vehicle of the aforesaid type to the extent that as few axes of motion as possible will be needed to convey the ammunition, that the mechanisms can be oriented with minimum expenditure, that the ammunition can be conveyed manually without a lot of physical effort in the event of a power outage or other malfunction, and that an escape path that is blocked as little as possible by the components of the ammunition feed will be provided to the rear of the vehicle for the driver sitting in the front.

This object is attained in accordance with the invention in that (f) the ammunition conveyor has a frame that is positioned in or immediately above the floor of the vehicle and pivots around an axis perpendicular to the floor with the ammunition-conveying arm sliding back and forth in rails on the frame and parallel to the floor, (g) the load-ready round tray is mounted on telescoping rails that slide back and forth in the ammunition-conveying rail and pivot up perpendicular to the floor of the vehicle around a horizontal axis on the end remote from the axis of rotation of the ammunition-conveying rail, (h) the loading tray is secured to the ammunition-transfer arm, is aligned with the axis of the weapon's bore when the ammunition-transfer arm is up and perpendicular to the floor of the vehicle in the path of the ammunition-conveying rail when the ammunition-transfer arm is down, and has a shell-grasping mechanism and a rammer, (i) the load-ready round tray has drive mechanisms and controls.

Advantageous embodiments of the combat vehicle in accordance with the invention are described hereinafter with reference to one embodiment by way of example.

The basic concept of the invention is to improve the system disclosed in the prior application by accommodating the ammunition at the center of the vehicle and designing the ammunition conveyor such that the latter can be very compact in height and require very few axes of motion. This flat design also makes it possible to keep the escape path through the vehicle fairly unobstructed and to accommodate a seat for an operator carrying out manual operations. Conveying the shells from the ammunition conveyor to the loading position is also simplified in that the load-ready round tray itself slides back and forth and rotates, so that the shell can be transferred directly from the load-ready round tray to the loading tray without additional means of conveyance.

The ammunition can be conveyed automatically all the way from the ammunition magazine to the loading position, controlled by mechanisms that are in themselves known. The stowage coordinates of the shells in the ammunition magazine can for example be stored along with other data in an ammunition-flow program so that the locations of prescribed shells can be called up as soon as the ammunition conveyor is activated.

The design of the overall ammunition feed from several individual components also makes it possible to replace subsidiary functions manually when they fail. Thus, if the ammunition conveyor malfunctions for example, a round an be removed manually from the ammunition magazine and inserted into the load-ready round tray. This operation will be discussed hereinafter with reference to one embodiment.

Furthermore, if the ammunition-conveying rail malfunctions, the round can be removed manually from the ammunition conveyor and positioned for loading.

The combat vehicle in accordance with the invention also has the following advantages among others:

1. When ammunition is stowed in the vehicle, its center of gravity will shift only slightly.

2. A large supply of ammunition can be stowed while retaining an efficient ammunition flow.

3. There is a lot of free combat space with an unobstructed floor inside the vehicle, and in particular an unobstructed escape route to the rear, whereby the vehicle can be entered and exited through a large hatch at the rear.

4. The shells can be positioned for loading either automatically or manually by means of simple subassemblies that can also be employed to stow ammunition in the vehicle, whereby the upright position of the ammunition ensures simple accommodation of the shells in the magazine and facilitates removing and handling them manually.

Embodiments of the combat vehicle in accordance with the invention and of the system for conveying the ammunition out of the ammunition magazine and into the loading position will now be described in detail with reference to the drawings, wherein

DETAILED DESCRIPTION OF THE INVENTION

Figure 1:
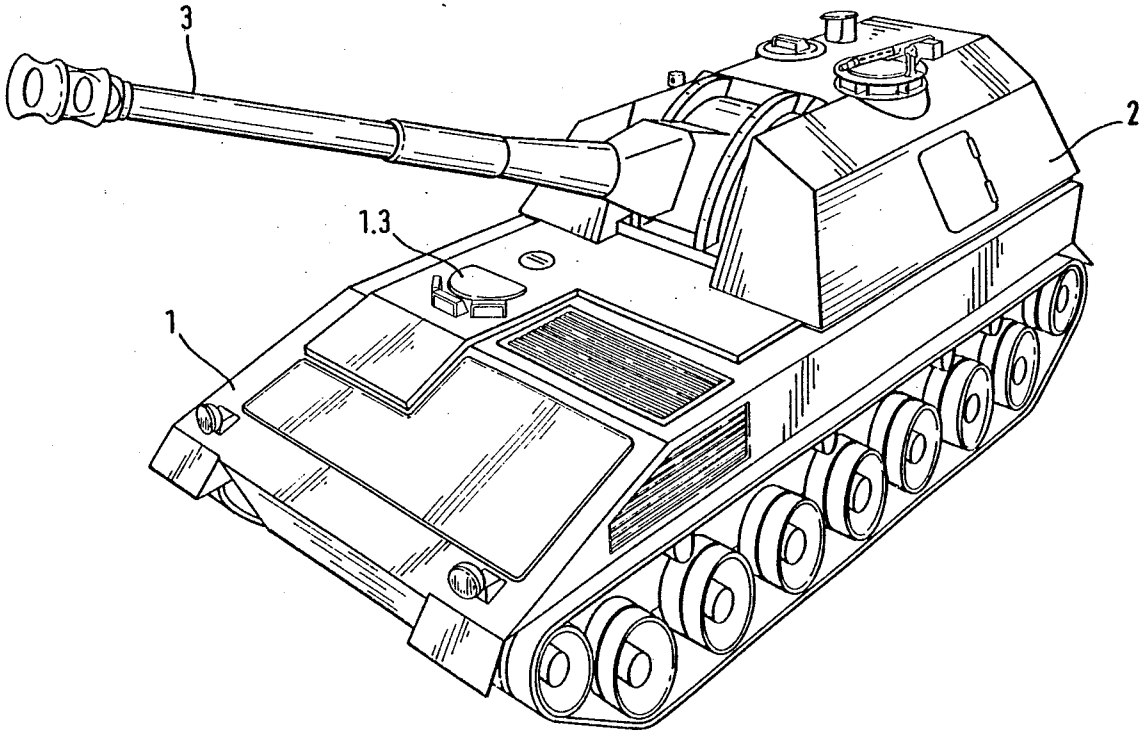
FIG. 1 is an overall perspective view of an armored howitzer.
Figure 2:
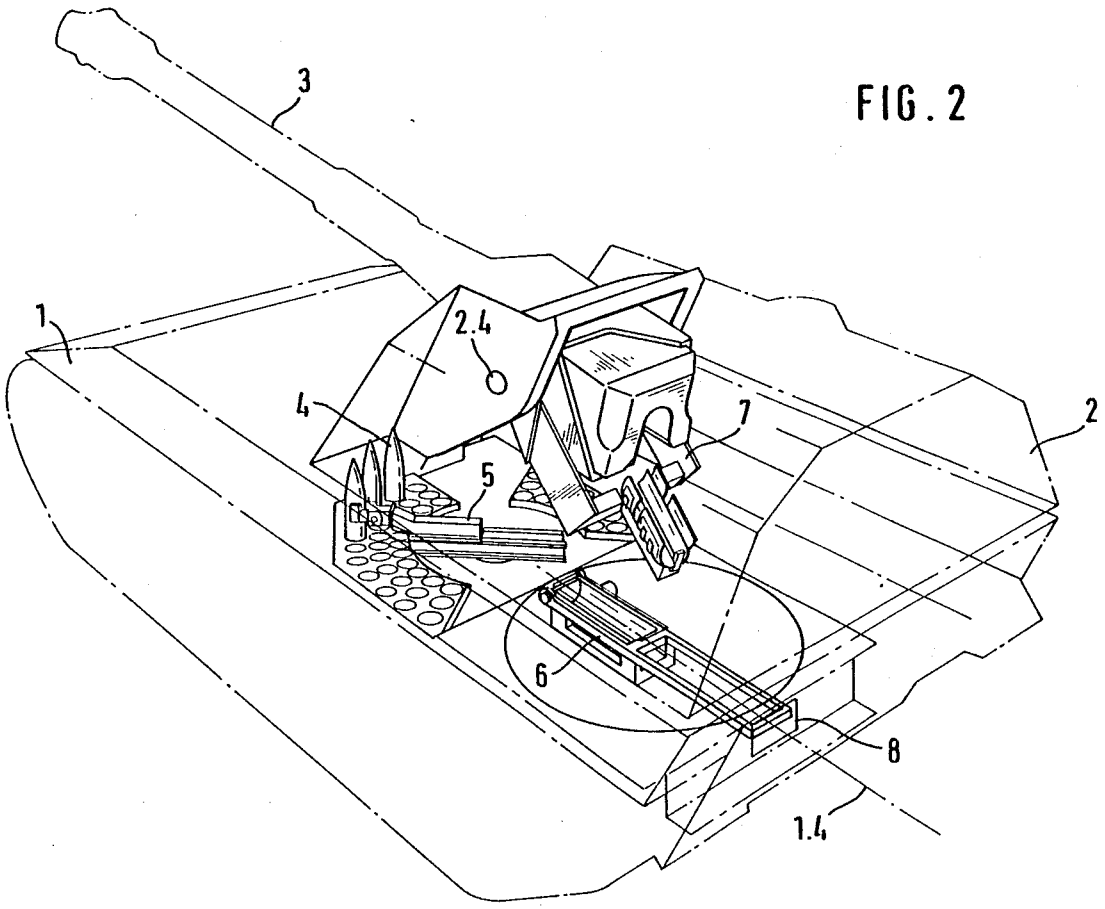
FIG. 2 is a highly schematic perspective view of the inside of the armored howitzer illustrated in FIG. 1 and of individual components of the ammunition feed.

The armored howitzer illustrated in the overall views in FIGS. 1 and 2 consists of a chain-tread vehicle 1 with a rotating turret 2 that has a heavy weapon 3 mounted on it.

It will be evident that turret 2 is on the rear half of the vehicle.

At the front of the vehicle is a driver's seat 1.3. As will be explained hereinafter, the ammunition is stowed at the center of the vehicle, which can be entered and exited in a way that is not illustrated through a large hatch in the rear.

Since the ammunition is stowed at the center of the vehicle, its center of gravity will shift only slightly when it is loaded.

Only the components of the vehicle that are essential for conveying the ammunition will be described in detail hereinafter, whereas other parts that are in themselves known and illustrated to some extent in the drawings will not be discussed in detail.

The ammunition is supplied, as will be evident from the overall view in FIG. 2 and specified hereinafter, by removing the shells from an ammunition magazine accommodated at the center of the vehicle with an ammunition conveyor 5. Ammunition conveyor 5 transfers them to an ammunition-conveying rail 6 below turret 2, where they are intercepted by an ammunition-transfer arm that pivots on the trunnion 2.4 of weapon 3 and positioned for loading behind weapon 3.

Three embodiments of the overall ammunition feed will now be described. They differ essentially in the design and distribution of the ammunition magazine and of the ammunition conveyor, whereas the design of ammunition-conveying rail 6 and ammunition-transfer arm 7 is the same in all embodiments.

Figure 3:
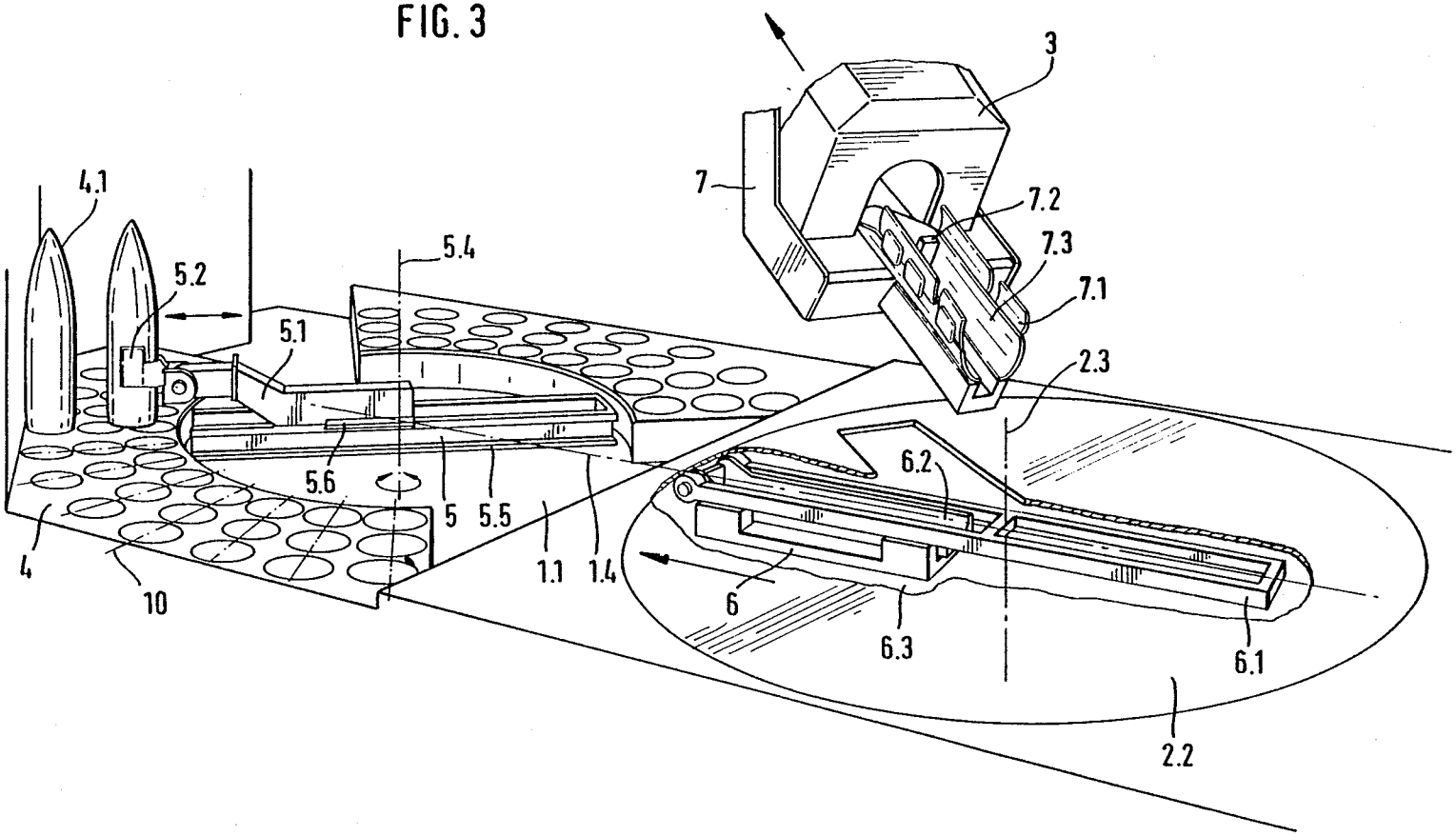
FIG. 3 is a larger-scale perspective view of part of the inside of one embodiment of the vehicle in accordance with the invention.
Figure 4:
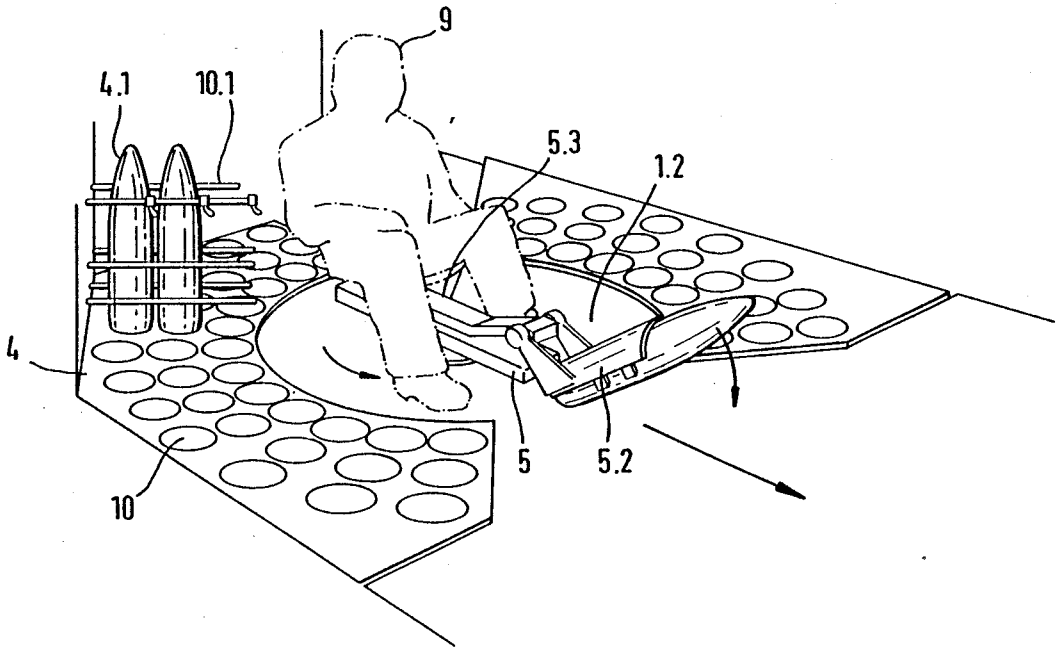
FIG. 4 illustrates part of the inside of the vehicle illustrated in FIG. 3 during another phase of conveying a shell.

The first embodiment, illustrated in FIGS. 3 and 4 has an ammunition magazine 4 on each side of the ammunition conveyor 5. The magazine accommodates shells 4.1 upright, and they are secured in that position by holders 10.1 that are in themselves known and will accordingly not be specified.

Between ammunition magazines 4 is an ammunition conveyor 5 with a frame 5.5 positioned immediately above the floor 1.1 of the vehicle and pivoting around an axis 5.4 that extends perpendicular to the floor along the longitudinal midline 1.4 of the vehicle. An ammunition-conveying arm 5.1 slides back and forth parallel to floor 1.1 along rails 5.6 on frame 5.5. Pivoting on the free outer end of ammunition-conveying arm 5.1 is a grip 5.2.

Shells 4.1 are aligned in ammunition magazine 4 along radiating lines 10 that intersect at the axis 5.4 of rotation of frame 5.5.

How ammunition conveyor 5 operates will now be described.

When a shell is to be removed, frame 5.5 pivots into alignment with one of lines 10. Ammunition-conveying arm 5.1 travels out, grip 5.2 (cf. FIG. 3) intercepts a shell 4.1, the shell clamp opens, and the shell is removed upright from its position. Frame 5.5 then pivots parallel with longitudinal midline 1.4 of the vehicle, and the shell is brought into transfer position 1.2 between ammunition conveyor 5 and the axis 2.1 of rotation of turret stage 2.2.

What happens to the shell as it is conveyed farther will be described hereinafter.

Figure 5:
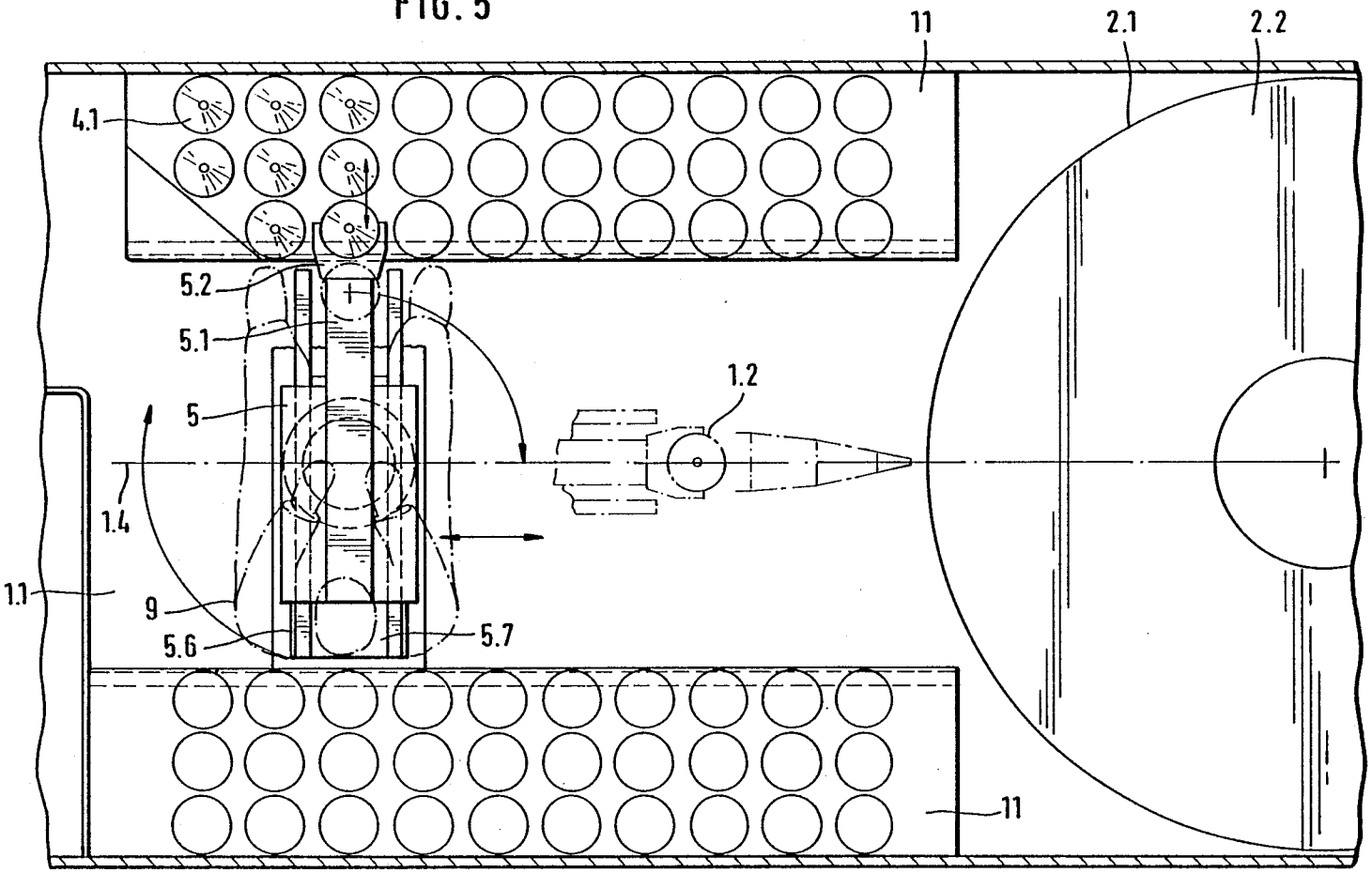
FIG. 5 is a larger-scale view of part of the inside of another embodiment of the invention.
Figure 6:
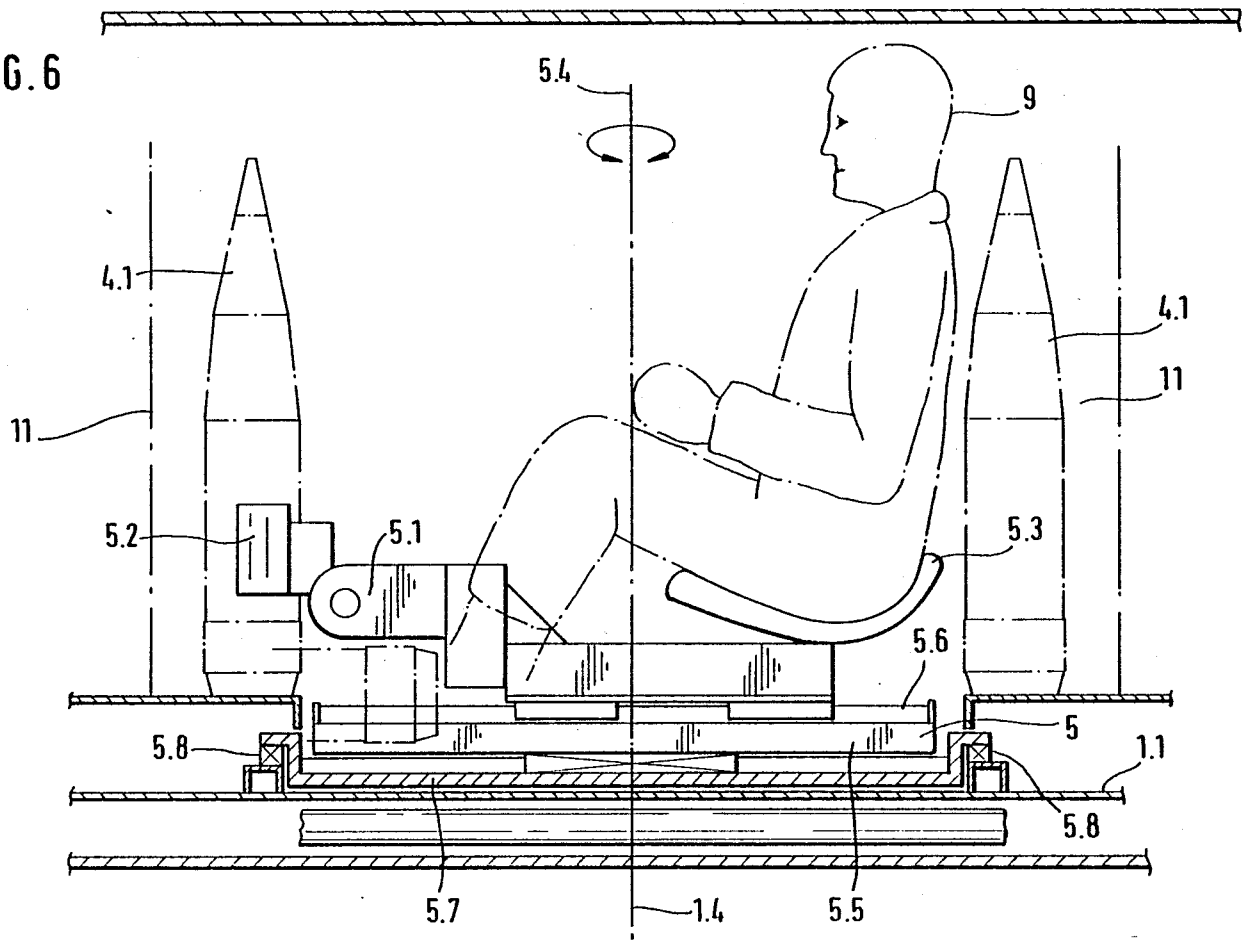
FIG. 6 is a view of the part of the inside of the vehicle illustrated in FIG. 5 along the length of the vehicle.
Figure 7:
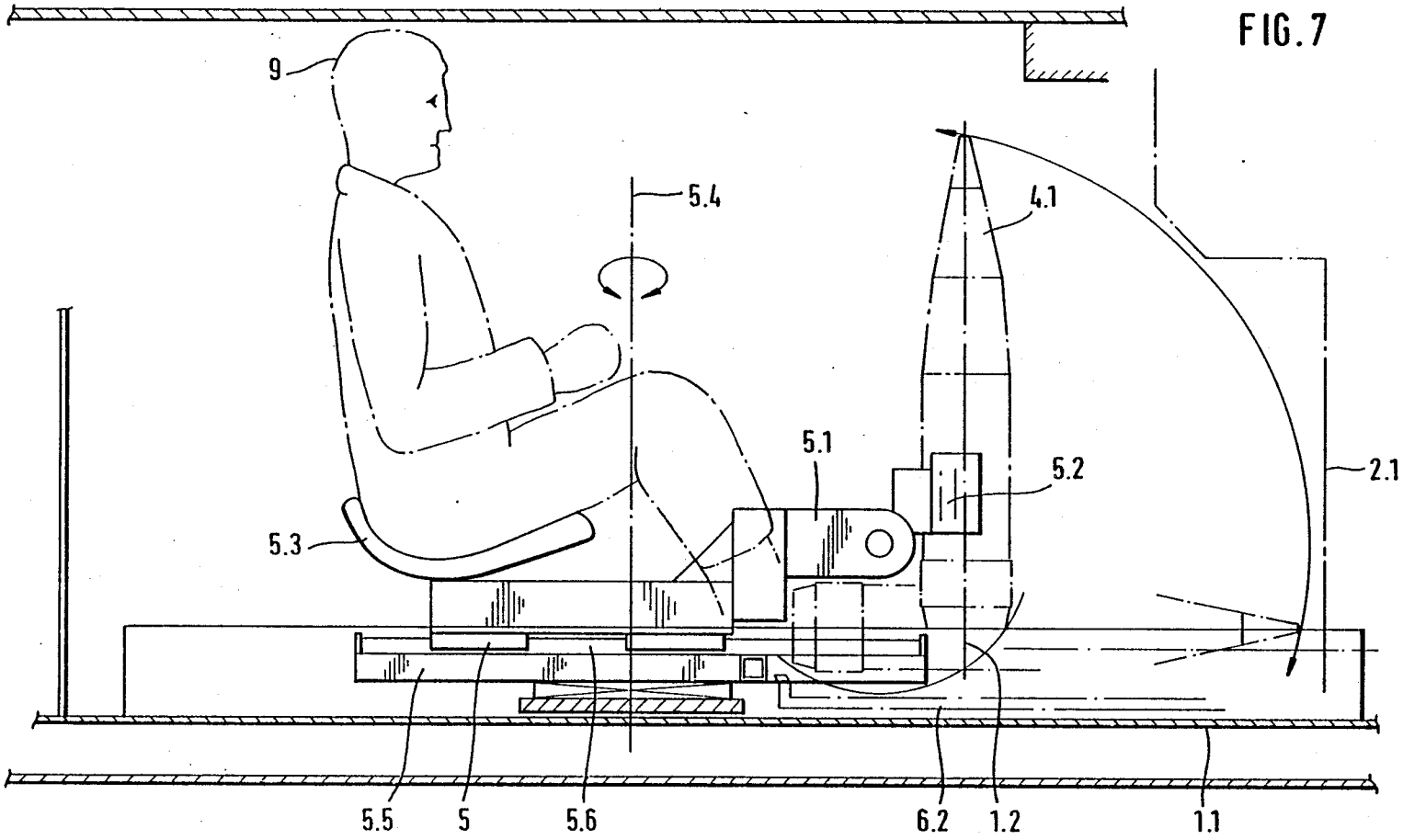
FIG. 7 is a view across the length of the vehicle of the part of the inside of the vehicle illustrated in FIGS. 5 and 6 during another phase of conveying the ammunition.

The embodiment illustrated in FIGS. 5 through 7 has an ammunition magazine in the form of a block magazine 11 on each side of ammunition conveyor 5. The upright shells are distributed along the inside of the walls of the magazine parallel to the longitudinal midline 1.4 of the vehicle. Shells 4.1 are also secured in block magazines 11 by clamps that are in themselves known and will not be specified.

The ammunition conveyor 5 in this embodiment has a higher degree of freedom in that it can travel back and forth along the longitudinal midline 1.4 of the vehicle. A longitudinal slide 5.7 is for this purpose mounted on two rails 5.8 secured to the floor 1.1 of the vehicle and parallel to its longitudinal midline 1.4. The previously described frame 5.5 rotates around axis 5.4 on slide 5.7. Again mounted on the frame is the ammunition-conveying arm 5.1 that slides back and forth on rails 5.6 with a grip 5.2 at its outer end.

When a shell is to be removed, ammunition conveyor 5 is, as illustrated in FIG. 5, advanced into the desired position in front of one of the two ammunition magazines 11. Frame 5.5 is then pivoted perpendicular to the longitudinal midline 1.4 of the vehicle, ammunition-conveying arm 5.1 travels out, and grip 5.2 intercepts a shell 4.1 and removes it from its position. Ammunition conveyor 5 is pivoted back parallel to the longitudinal midline 1.4 of the vehicle, and ammunition conveyor 5 is displaced longitudinally until the shell is in transfer position 1.2.

Figure 8:
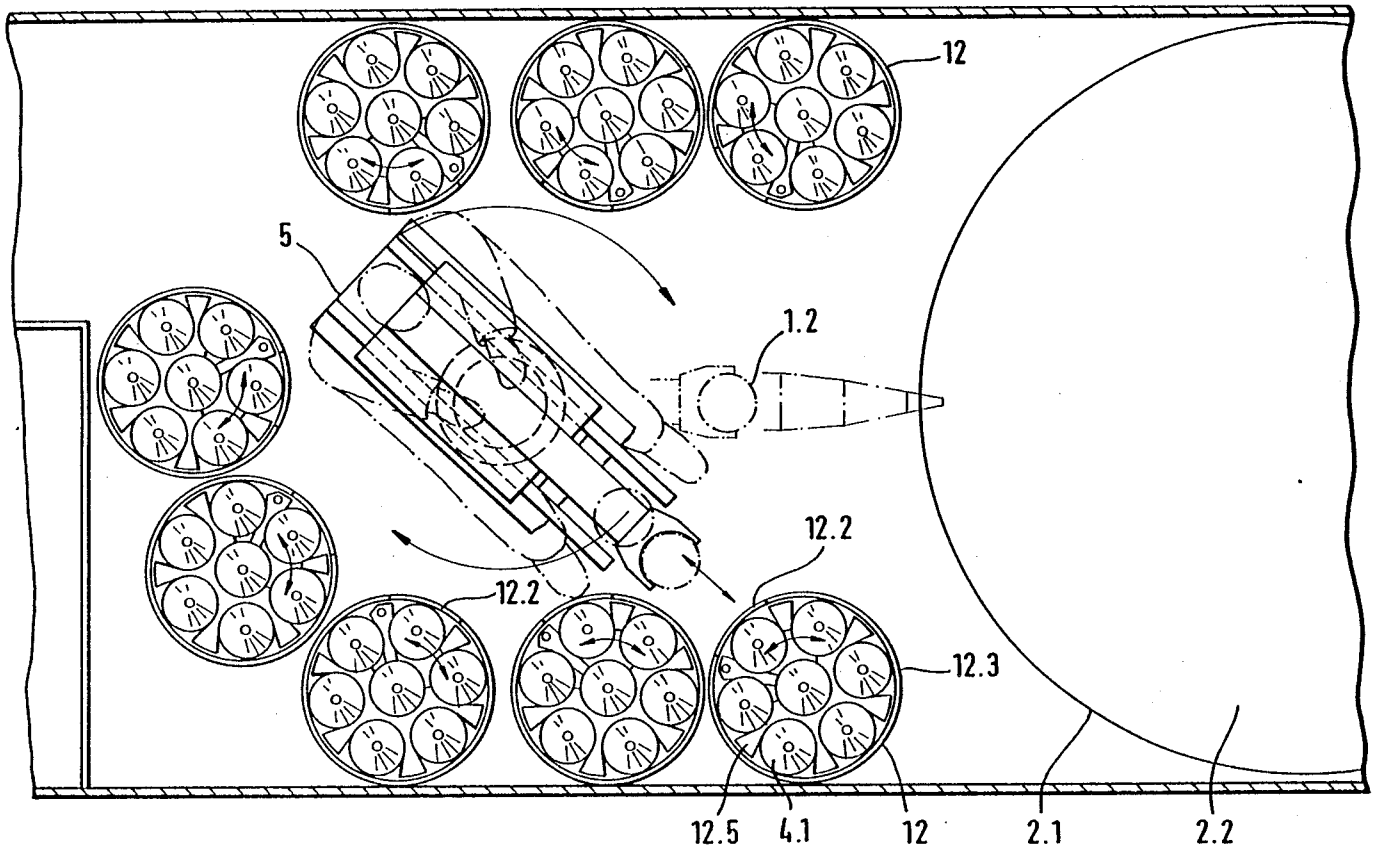
FIG. 8 is a view of part of the inside of a third embodiment of the invention.
Figure 9:
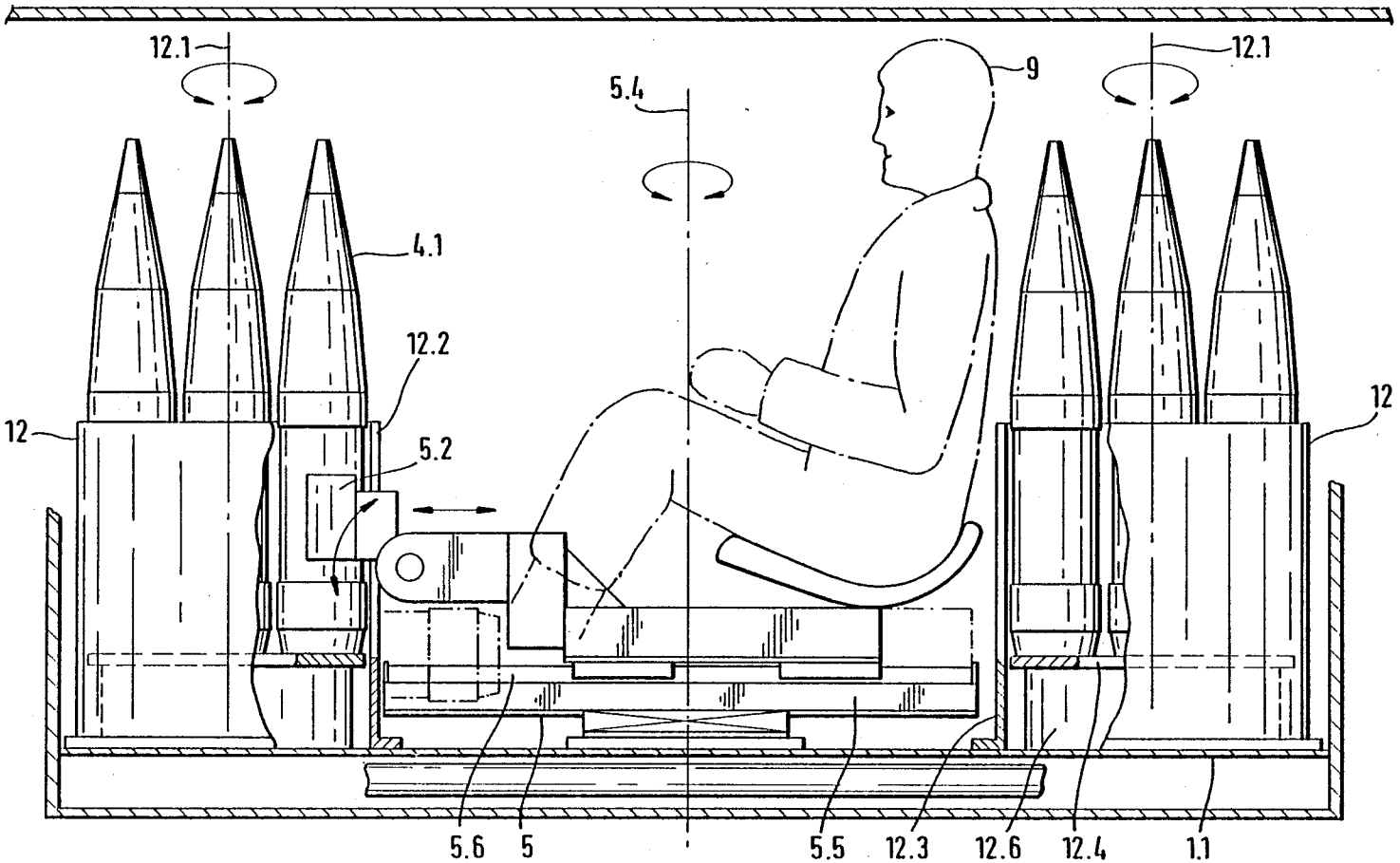
FIG. 9 is a view along the length of the vehicle of the part of the inside illustrated in FIG. 8.
Figure 10:
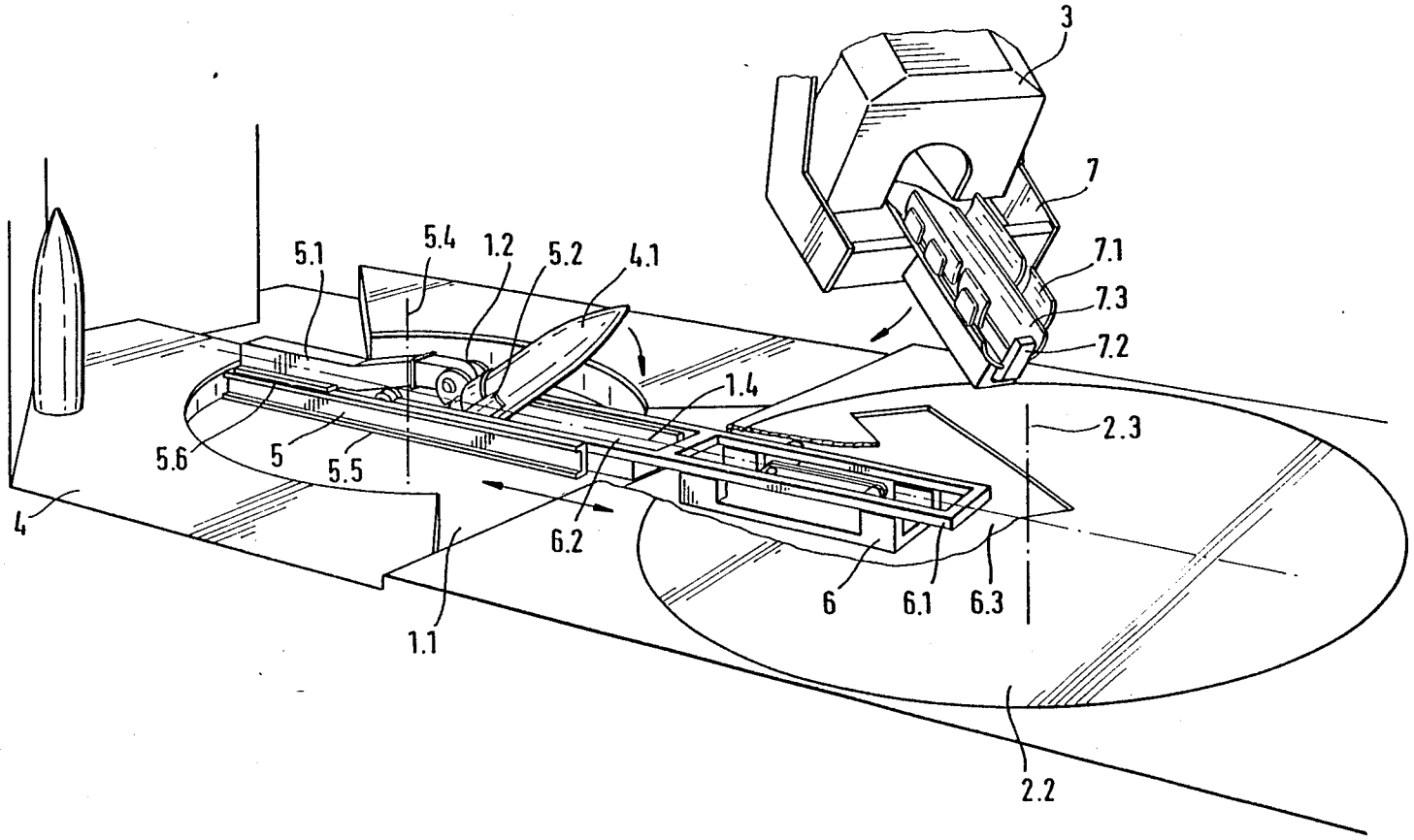
FIG. 10 is a view of the inside of the vehicle similar to that in FIG. 3 but during another phase of conveying the ammunition.

In the embodiment illustrated in FIGS. 8 and 9, the upright shells 4.1 are stowed in several drum-type magazines 12 distributed along the inner walls of the vehicle around ammunition conveyor 5, each magazine rotating around a perpendicular axis 12.1. The cylindrical outer walls 12.3 of the drums are secured to floor 1.1 of the vehicle, and each has a shell-removal opening 12.2 facing the axis 5.4 of rotation of the frame 5.5 of ammunition conveyor 5. The shells rest upright on a base plate 12.4 accommodated inside the housing of the drum and are secured in a star-shaped shell holder 12.5. Base plate 12.4 can be shifted incrementally by an electric motor 12.6 to allow any desired shell to be removed through opening 12.2 by ammunition conveyor 5.

The design of the ammunition conveyor 5 in this embodiment is the same as that of the conveyor illustrated in FIGS. 3 and 4, meaning that it rotates only around the axis 5.4 of rotation perpendicular to the floor 1.1 of the vehicle.

When a shell is to be removed, frame 5.5 pivots into alignment with the shell-removal opening in the powered drum 12, ammunition-conveying arm 5.1 travels out, and grip 5.2 removes shell 4.1 from shell holder 12.5 and brings it into transfer position 1.2.

What happens to the shells as they are conveyed beyond the transfer position 1.2 in ammunition conveyor 5 will now be described.

Centered on the floor 1.1 of the vehicle below rotating turret 2 is a rotating ammunition-conveying rail 6. It consists essentially of a turntable 6.3 that rotates around the axis 2.3 of rotation of turret 2 and parallel with the floor 1.1 of the vehicle and of telescoping rails 6.1 secured thereon. Telescoping rails 6.1 can be advanced radially to turntable 6.3. Mounted on telescoping rails 6.1 is a load-ready round tray 6.2 that rotates approximately 90° to the plane of rotation. The horizontal axis of rotation of load-ready round tray 6.2 is at the end facing away from the axis 2.3 of rotation of turntable 6.3.

Also pivoting on the trunnions 2.4 of weapon 3 is an ammunition-transfer arm 7 that can be lowered into the vehicle independent of the weapon into a plane that coincides with or parallels the plane of elevation and is designed such that its individual components are all located below and behind the end of the weapon. At the rear of ammunition-transfer arm 7 a loading tray 7.3 is secured to ammunition-transfer arm 7. The overall design makes it possible for loading tray 7.3 to be aligned with the axis of the weapon's bore when ammunition-transfer arm 7 is up and perpendicular to the floor 1.1 of the vehicle in the path of ammunition-conveying rail 6 when the ammunition-transfer arm is down. The tray also has a shell-grasping mechanism 7.1 and a rammer 7.2.

Ammunition conveyor 5 conveys the shells, as will be evident from FIGS. 10 through 13, from transfer position 1.2 to the loading position in the steps that will now be described.

Ammunition conveyor 5 is in the transfer position, which is particularly well illustrated in FIG. 4. Ammunition-conveying rail 6 pivots into an interception position illustrated in FIG. 3. Telescoping rails 6.1 slide along with pivoting load-ready round tray 6.2 as will be evident from FIG. 10 below shell 4.1, which is in the transfer position. The grip 5.2 on ammunition conveyor 5 tilts the shell horizontally and transfers it to load-ready round tray 6.2. Telescoping rails 6.1 and load-ready round tray 6.2 travel back into the vicinity of the axis 2.1 of rotation of ammunition-conveying rail 6 as illustrated in FIG. 11.

Figure 11:
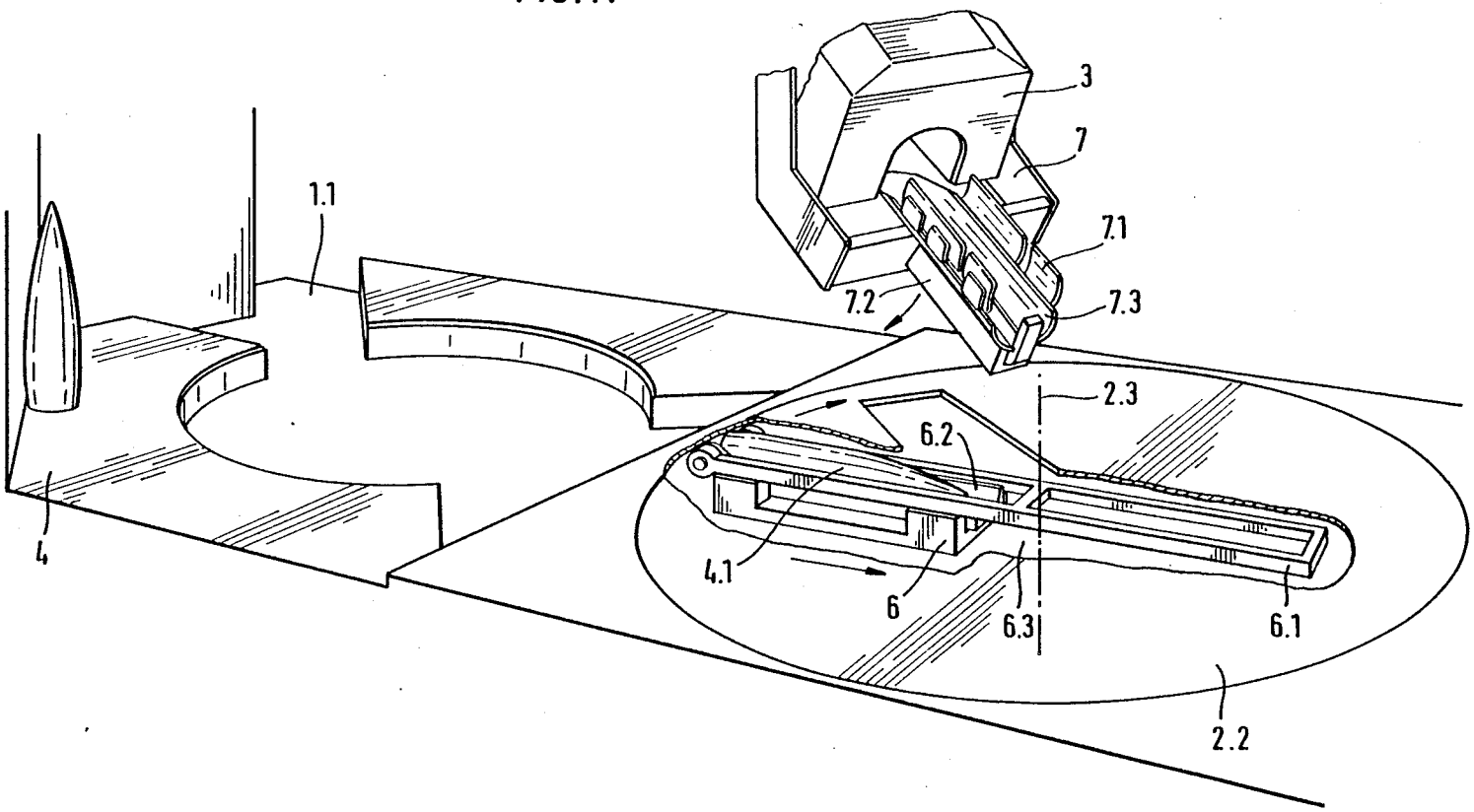
FIGS. 11 through 13 are views similar to that in FIG. 10 during further phases of conveying the ammunition.
Figure 12:
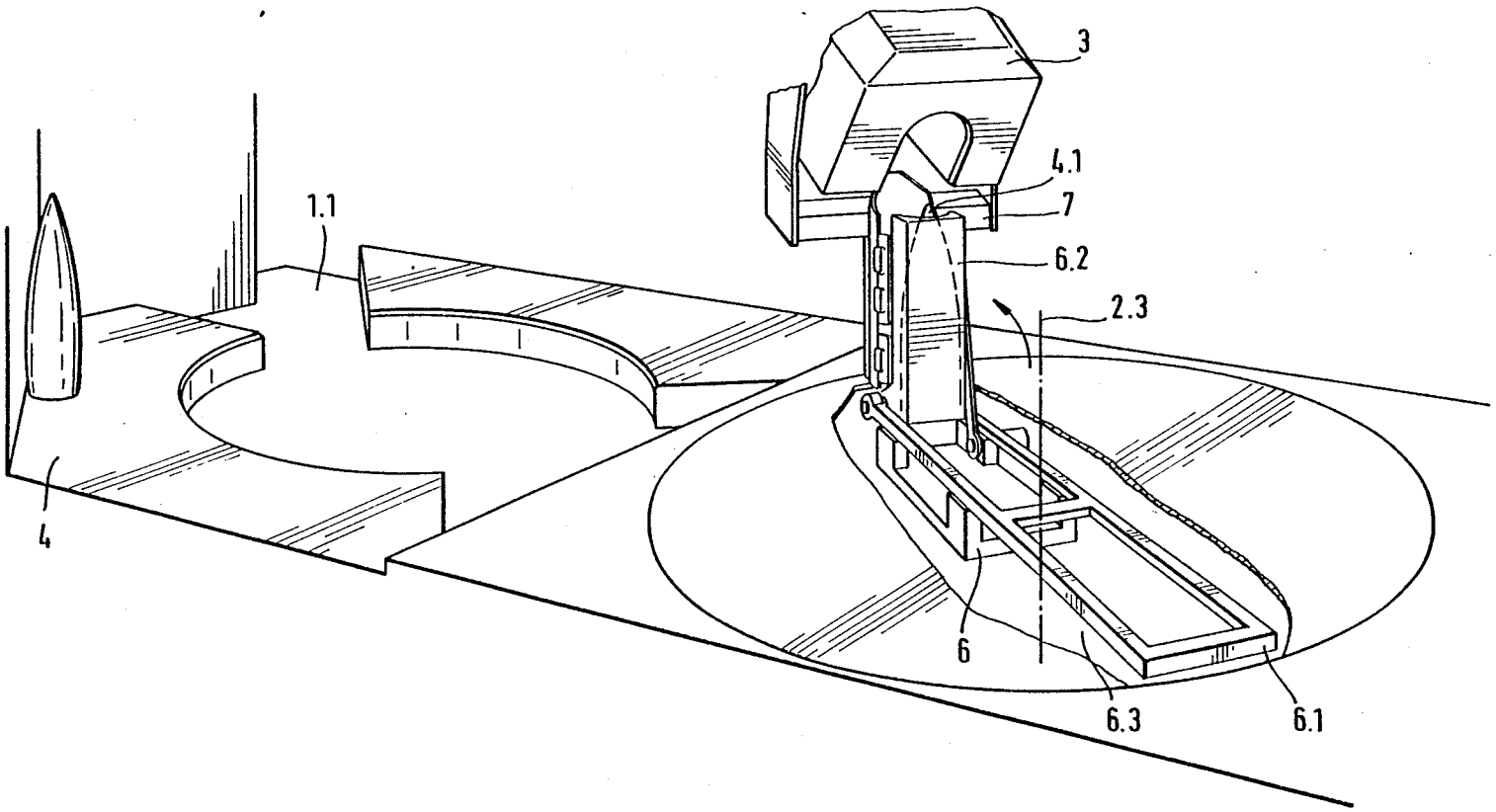
Figure 13:
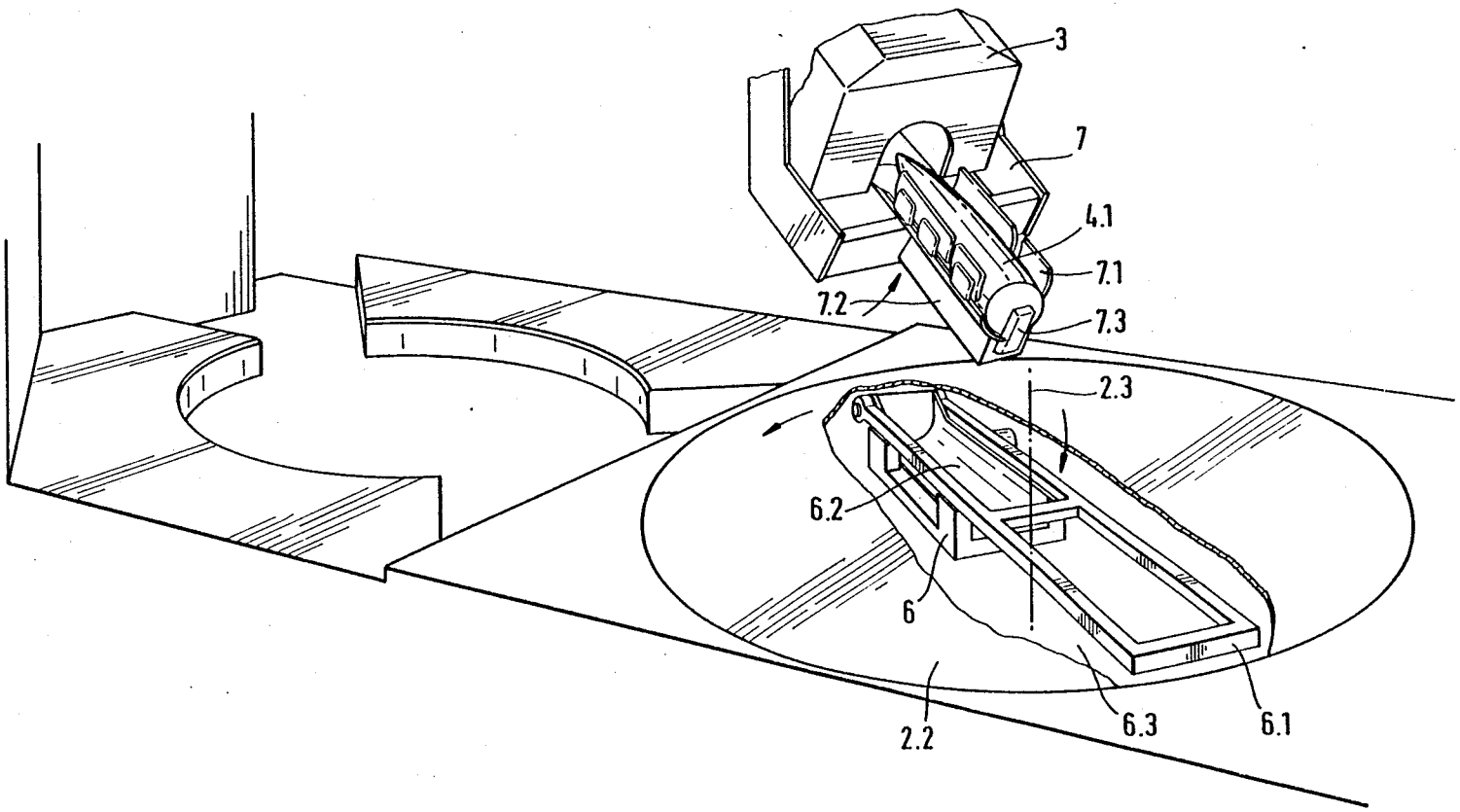

Ammunition conveyor 5 is, for simplicity's sake, not illustrated in FIGS. 11 through 13.

While ammunition-conveying rail 6 is in motion, ammunition conveyor 5 is returned to a position in which it can remove a fresh round from the magazine.

Ammunition-conveying rail 6 pivots the round in load-ready round tray 6.2 into the weapon's azimuth position illustrated in FIG. 12 below turret stage 2.2. FIG. 12 also illustrates how the ammunition-transfer arm 7 of weapon 3 is pivoted down inside the vehicle until loading tray 7.3 is perpendicular to the turntable at the end of ammunition-conveying rail 6. Load-ready round tray 6.2 pivots shell 4.1 out of its horizontal position and into a vertical position in the loading tray 7.3 on ammunition-transfer arm 7 and immediately pivots back empty into its original position.

Round 4.7 is secured in loading tray 7.3 by shell-grasping mechanism 7.1, and ammunition-transfer arm 7 pivots with the round positioned in loading tray 7.3 into the same elevation position as that of weapon 3, where it locks in automatically with the weapon system. This position is illustrated more precisely in FIG. 13. Rammer 7.2, which is not specified herein, then conveys shell 4.1 into the breach of weapon 3.

Meanwhile, ammunition-conveying rail 6 can pivot back into its original position along the length of the vehicle to intercept another shell.

The mechanisms that activate ammunition conveyor 5, ammunition-conveying rail 6, and ammunition-transfer arm 7 are of known design and are not illustrated or specified.

The overall procedure for supplying the rounds can be completely automated, controlled by appropriate electronic devices. If certain functions fail, however, the individual components of the ammunition feed can also be operated manually.

Thus, if ammunition conveyor 5 breaks down, a shell can be removed manually from ammunition magazines 4, 11, or 12 and positioned in load-ready round tray 6.2.

For this purpose a seating shell 5.3 is secured to the frame 5.5 of ammunition conveyor 5 as will be especially evident from FIGS. 4, 6, 7, and 9. All the mechanisms that drive the axes of motion are electrically and mechanically disengaged. One crew member 9 can from a sitting position execute all the motions of ammunition conveyor 5 with little physical effort. The requisite mechanisms—handles, Bowden cables, etc. for example—are not individually illustrated.

If ammunition-conveying rail 6 breaks down, the crew member 9 sitting on the ammunition conveyor can hand the round, tilted approximately 45° (cf. FIG. 4), directly into the combat space, where it can be intercepted by the loading gunner.

The ammunition feed described herein can also be employed in a very simple way to load and unload the vehicle with ammunition. For this purpose a supply hatch 8 is provided behind ammunition-conveying rail 6 at the rear of the vehicle (cf. FIG. 2). Load-ready round tray 6.2 can travel out through this hatch to be loaded outside.

The ammunition is deposited manually in load-ready round tray 6.2 and automatically conveyed farther on by ammunition-conveying rail 6, subsequent to which it is either, as previously described herein, directly lifted to weapon 3 by ammunition-transfer arm 7 or, with the ammunition-transfer arm up, removed from the pivoted-up load-ready round tray 6.2 by the grip 5.2 on ammunition conveyor 5 and supplied to the ammunition magazine. The ammunition is unloaded in the opposite sequence and can be removed at the rear of the vehicle.

It will be appreciated that the instant specifications and claims are set forth by way of illustration and not limitation, and that various modifications and changes may be made without departing from the spirit and scope of the present invention.

What is claimed is:

1. In a combat vehicle having an interior space having a center and including a floor, and an exterior including a turret and a heavy weapon mounted thereon for elevated and lowered movement, at least one ammunition magazine in the interior space adjacent the center for storing shells in an upright position, and means for feeding the shells to the weapon one at a time, the improvement wherein the feeding means comprises: conveying means for removing one shell from the at least one ammunition magazine comprising a frame, means mounting the frame for rotation about an axis perpendicular to the floor for movement from a pick-up position to a transfer position, rails on the frame disposed parallel to the floor, an arm slidably mounted on the rails for movement therealong parallel to the floor, means mounted on the arm for gripping a shell and pivotable from a first position wherein the shell is upright to a second position wherein the shell is aligned with the length of the vehicle, wherein the gripping means is operative in the first position to grip a shell when the frame is in the pick-up position and is operative in the second position to release a shell when the frame is in the transfer position, a shell tray, means mounting the shell tray for sliding movement parallel to the floor between a receiving position wherein the shell tray receives a shell released by the gripping means and a holding position, means for rotating the shell tray about an axis perpendicular to the floor from the holding position to an azimuth position parallel to a bore of the weapon, a loading tray parallel to the bore, means for elevating the shell tray to transfer the shell to the loading tray and means for elevating the loading tray to align the shell with the bore for sliding movement therein.

2. The combat vehicle according to claim 1, wherein the at least one ammunition magazine comprises shell holders disposed on both sides of the frame and along lines radiating from the axis of rotation of the frame.

3. The combat vehicle according to claim 1, wherein the at lest one ammunition magazine comprises a plurality of rotatable drum shaped magazines.

4. The combat vehicle according to claim 3, wherein each drum shaped ammunition magazine comprises a cylindrical outer wall with an ammunition opening facing the axis of rotation of the frame.

5. The combat vehicle according to claim 4, wherein each drum shaped ammunition magazine comprises a star shaped shell holder rotatably mounted in the cylindrical outer wall.

6. The combat vehicle according to claim 1, wherein the at least one ammunition magazine comprises an ammunition magazine on each side of the frame for holding shells in rows paralleling the length of the vehicle and means for mounting the frame for sliding movement along the length of the vehicle.

7. The combat vehicle according to claim 1, further comprising an entry behind the center of the vehicle and wherein the means for rotating the shell tray includes means for positioning the shell tray along the length of the vehicle and below the entry.

* * * * *